US005366019A

United States Patent [19]

Brooks

[11] Patent Number: 5,366,019

[45] Date of Patent: Nov. 22, 1994

[54] HORIZONTAL INFLATABLE TOOL

[75] Inventor: Robert T. Brooks, Houston, Tex.

[73] Assignee: CTC International, Houston, Tex.

[21] Appl. No.: 40,345

[22] Filed: Mar. 30, 1993

[51] Int. Cl.[5] ..... E21B 33/00

[52] U.S. Cl. ..... 166/387

[58] Field of Search ..... 166/387, 123, 181, 182, 166/187, 381

[56] References Cited

U.S. PATENT DOCUMENTS

| | | | |
|---|---|---|---|
| 4,796,707 | 1/1989 | Halbardier | 166/387 |
| 5,000,265 | 3/1991 | Pleasants et al. | 166/387 |
| 5,044,441 | 9/1991 | Rubbo et al. | 166/387 X |
| 5,095,978 | 3/1992 | Akkerman et al. | 166/387 X |

*Primary Examiner*—Michael Powell Buiz
*Attorney, Agent, or Firm*—Donald H. Fidler

[57] ABSTRACT

A system for inflating an inflatable packer located in a well bore on a liner where the inflatable packer has an inflation valve and a latching recess. An inflation tool with inner and outer assemblies is disposable by a string of tubing to a position within the inflatable packer where cup members on the outer assembly straddle the inflation valve and friction drag block members on the outer assembly are located in an annular recess above the inflation valve. An automatic J-slot interconnects the inner and outer assemblies so that the inner assembly can be repetitively moved between an intermediate, a lower and an upper location to open and close flow ports for a valve in the inner and outer assemblies with the value being in fluid communication with the inflation packer in the lower location and where the drag blocks are locked into the recess while the inner assembly is in the lower location and where the valve is closed in the intermediate and the upper locations; so that multiple inflations of multiple inflatable packers can be accomplished with one trip in the well bore.

15 Claims, 5 Drawing Sheets

HORIZONTAL INFLATABLE TOOL

FIELD OF INVENTION

This invention relates to a system for selectively isolating a lengthwise extending segment of a tubular member disposed in a well bore and for selectively operating a valve between a string of tubing and the isolated segment for transferring liquid between the isolated segment in the tubular member and the string of tubing. The system utilizes a well tool on which a string of tubing can be selectively anchored with respect to a tubular member and which can selectively open a valve in the well tool solely by longitudinal motion of a string of tubing. More particularly, the invention has a specific application to systems for selectively injecting liquid cement slurry or a liquid mud in a string of tubing into an inflatable packer device in both a vertical and horizontal or non-vertical well bore for inflating the packer device.

BACKGROUND OF THE INVENTION

Horizontal drilling of well bores is a relatively recent technology where an initial segment of a well bore extends in a generally vertical direction and then is angled in a direction which can be normal to a vertical or with other angular relationships with respect to the initial vertical segment of the well bore. Where a horizontal or non-vertical section of the well bore traverses earth formations which contain hydrocarbons it is desirable to isolate selected formations from one another along a segment of the well bore from other sections along the well bore.

The present invention provides a practical system for obtaining a cement type sealing mechanism in the annulus between a well pipe and a well bore in horizontal or non-vertical sections of a well bore.

In U.S. Pat. No. 5,082,062 a system is disclosed where an inflatable packer in a string of pipe has a latching profile. An actuating tool carried on a string of tubing is receivable in the inflatable packer and is mechanically arranged to have latching fingers for selectively engaging the latching profile so that downward motion on the string of tubing can be used to set the inflation tool in the inflatable packer and permit use of cement or mud slurry to inflate the inflatable packer. This system has a certain mechanical complexity and requires the latching profile to be located below the inflatable packer and uses weight set packing elements.

Where multiple inflatable packers with different lengths are utilized, the location of a latching profile above the packer permits a single tool to be uniformly applicable in actuating the packers because the profile and actuating valve can be uniformly spaced irrespective of the length of the packer. Also the tool is considerable shorter which is always an advantage.

SUMMARY OF THE INVENTION

The present invention is particularly useful in a system where a string of pipe is disposed in a well bore which includes horizontal and angularly deviated sections and where the string of pipe carries spaced apart inflatable packer devices in the angularly deviated sections. Inflatable packer devices are well known and are of the type which can be inflated by the injection of cement slurry or a mud slurry under pressure through an access port in the packer device. The liquid slurry under pressure fills and inflates an inflatable packer element along the elongated packer element typically about 20 to 40 feet in length and is trapped in the packer. The inflated packing element on the inflatable packer isolates the well bore with respect to an attached casing or drill pipe.

The present system contemplates use of an actuating well tool at the end of a string of tubing which can be inserted through an existing well pipe in the well bore and located in an inflatable packer device. The well tool has cup type packer elements above and below a normally closed flow valve where the packer elements are positioned to straddle a cement access port in the inflatable packer device. The well tool has latching elements which are spring biased outwardly and register with a latching profile in the inflatable packer in a location above the inflatable packer.

The well tool has an automatic J-system which is mechanically actuated by longitudinal movement of the string of tubing to positively latch the latching element in the latching profile and operate the flow valve.

The J-system is actuated by longitudinal movement of the string of tubing to open the valve between the cup members and a tubing dart member can be pumped down the string of tubing and latched in a releasable collar. The dart member permits a check of the integrity of the sealing of the cup members by applying pressure to the liquid in the string of tubing. This is important because cups can be damaged while moving through a well bore and lack of sealing integrity can adversely affect the operation. The tubing dart member is released prior to inflation of the inflatable packer.

Following release of the tubing dart members, a second dart member followed by an inflating cement or mud slurry is pumped down the string of tubing so that the slurry can be pumped through the string of tubing and into the inflatable packer device to inflate the packer element on the inflatable packer. Following inflation of the packer device, the flow valve in the actuating well tool is closed by use of the automatic J-system. Next, the well latching members are released by operation of the automatic J-system so that they are retractable from the latching profile and so that the string of tubing can be moved to a second inflatable packer device where the operation can be repeated to selectively inflate a second inflatable packer device.

When all of the inflatable packer devices in the string of pipe are inflated as described above, a circulation valve in the string of tubing is opened so that the liquid slurry in the string of tubing can be reversed out to the earth's surface.

During this entire operation of inflating the inflatable packer devices, the slurry contained within the string of tubing is used to selectively inflate one or more packer elements of inflatable packer devices located in a string of pipe in a well bore and is retrievable with the well tool upon completion of the operations or can be reversed out of the tubing string without leaving cement in the well bore.

DESCRIPTION OF THE INVENTION

Figure 1:
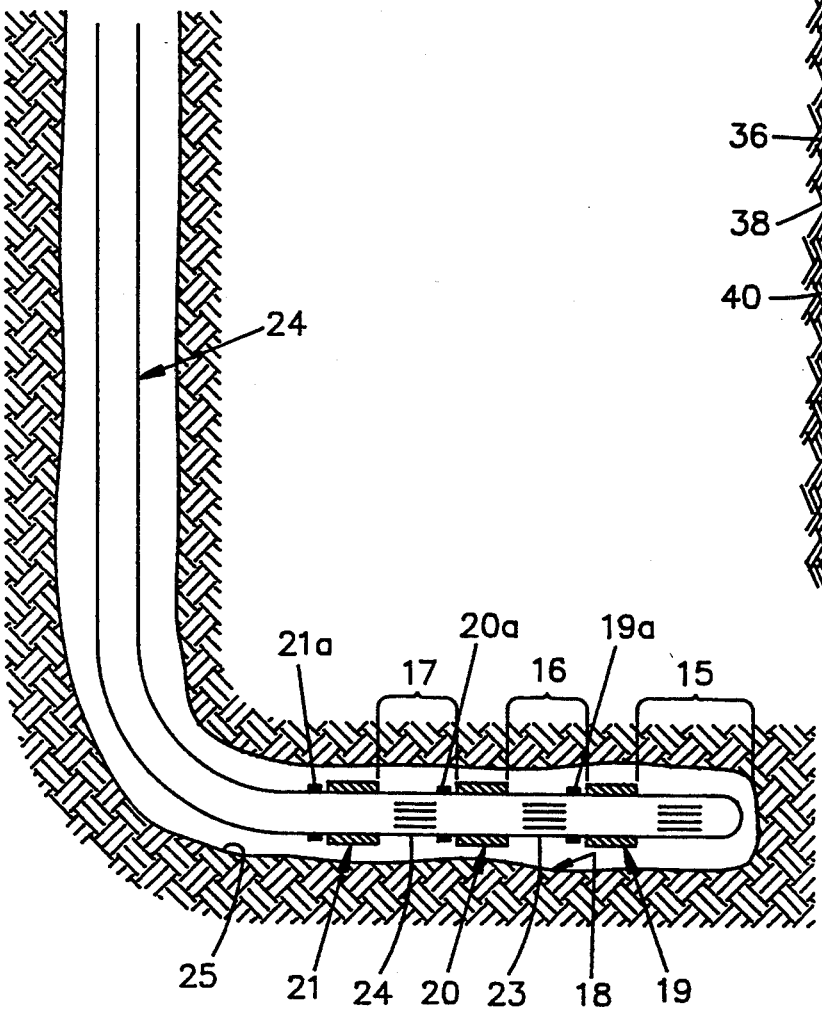
FIG. 1 is a schematic representation of an application of the present invention in a well bore environment.

Referring to FIG. 1 in completing well zones such as the zones 15, 16 and 17 indicated in the drawings where there is a horizontal section or non-vertical section 18 of well bore, spaced apart inflatable packers 19, 20 and 21 are connected to one another by an interconnecting pipe members 22 and 23 and are connected by a string of pipe or casing 24 to the surface of the ground. The section of pipe 22 and 23 located between the inflatable packers 19 and 20 and between packers 20 and 21 can be pre-slotted or can be perforated for fluid flow before the inflatable packers are expanded.

The inflatable packers can be, for example, of the type illustrated in U.S. Pat. No. 4,402,517 where an elongated elastomer packer element is disposed about a central metal tubular member. The valving for the inflation of the packer element is preferably at an upper end of the tool and serves to control the admission of cement and inflation of the packer element. In the present invention a knock out cap is not required and the opening to an inflation valve is at the inner wall of the central member. When a liquid cement or mud slurry is introduced into the annular space between the inflatable packer element and the central tubular member, the pressure operated inflation valve is actuated and the packer element is inflated into sealing engagement with the wall of the well bore 25 thereby providing fluid tight seal of the wall of the well bore with respect to the central tubular member of the inflatable packer. It can be appreciated that where the inflatable packers are spaced from one another, the zone intermediate of adjacent inflatable packers can be produced through perforations in the connecting pipe 24 to the ground surface.

Associated with each packer 19, 20, 21 is an anchor profile member 19*a*, 20*a*, and 21*a*. The profile member 19*a*, 20*a*, 21*a*. The profile member 19*a*, 20*a* or 21*a* is located above or on the upper end of an inflatable packer.

Figure 2:
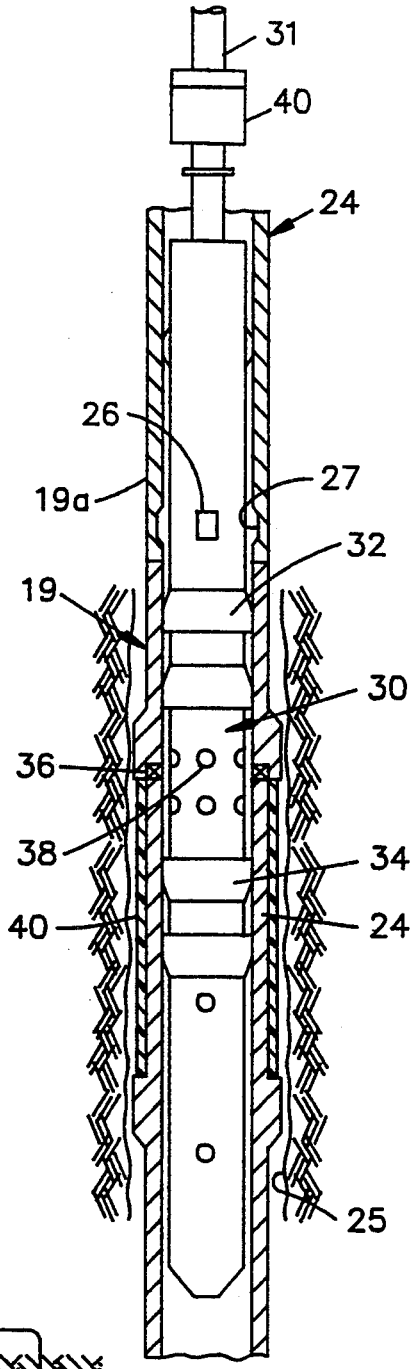
FIG. 2 is an outline illustration of an assembled well tool according to the present invention.

As shown in FIG. 2, in one aspect of the present invention, a selectively operated well tool 30 at the end of a string of pipe 31 is passed through the string of pipe 24 to a location within the lowermost or the inflatable packer 19. This packer 19 is the most remote from the end of the string of pipe located at the earth's surface. An anchor or latching means 26 on the well tool 30 cooperates with a recessed annular profile groove 27 in a profile member 19*a*, to positively anchor the well tool 30 relative to the packer 19. The selectively operable well tool 30, when anchored with respect to an annular profile member 19*a* on the upper end of an inflatable packer, has a pair of spaced apart cup type packer elements 32, 34 on the well tool 30 which are used to isolate a packer valve 36 in the packer where the packer valve is located between the packer elements 32, 34 in the well tool 30. The well tool 30 has a selectively operable valve to place a valve opening 38 in the well tool into fluid communication with the packer valve 36 so a that liquid cement slurry or a mud slurry can be pumped down the string of tubing 31 and moved through the selectively operated valve in the well tool 30 to the isolated packer valve 36 located between the spaced apart packer elements 32, 34. When the liquid cement or mud slurry is passed through the valve opening 38 between the packer elements 32, 34 on the well tool 30 and enters into the packer valve 36 of the inflatable packer device, the elastomer packer element 40 on the inflatable packer device 19 is inflated. When the inflatable packer element 40 is fully deployed or inflated and is in sealing operative contact with the well bore 25, the operator picks up or lifts the string of tubing 31 which closes the valve in the well tool 30 and prevents liquid cement or mud slurry in the string of tubing from escaping from the string of tubing and the upward movement of the string of tubing also releases the well tool 30 from the profile member 19*a* and unanchors the well tool so that it can be raised or shifted to the next closest inflatable packer device. It should be noted that with the present invention, the packers can be inflated in any order and are not required to be inflated from the lowermost packer up.

When the well tool reaches the next inflatable packer device 20, (See FIG. 1) the anchor 26 on the well tool 30 is again set by a longitudinal downward motion of the tubing string 31 so that the valve opening 38 is located proximate to the inflation valve of the inflatable packer device 20. After the anchoring the well tool, in the packer device 20 the spaced apart cup packer elements 32, 34 straddle the inflation valve in the packer and the valve in the well tool and then is opened so that cement in the string of tubing 31 can be introduced through the inflation valve 36 in the inflatable valve 36 in the inflatable packer 20 and inflate the inflatable packer element to a sealing condition with respect to the well bore wall. After this inflatable packer element is fully extended, the string of tubing is again manipulated and the valve in the well tool 30 is first closed followed by unanchoring of the well tool so that it is released from the inflatable packer 20. As may be appreciated if there are more than two inflatable packer devices in the well bore, this process can be sequentially repeated until all of the selected packer devices are inflated as desired.

In the foregoing system, the well tool 30 has latching means 26 which serve to locate the well tool relative to a profile member (19*a*, for example). The anchoring or latching means 26 are selectively actuated in an extended condition outwardly of the well tool to engage and lock the latching means 26 in a profile recess 27 in the well packer.

A circulating valve 40 is coupled between the string of tubing 31 and the well tool 30. When the last inflation of an inflatable packer device is completed, the tool 30 is located in a blank section of casing and pressure is applied in the string of tubing to open the pressure operated circulating valve 40 in the string of tubing. When the circulating valve 40 is opened, the cement in the string of tubing can be pressured out through the tubing and returned to the earth's surface by pumping fluid down the annular space and through the string of tubing which is a well known process known as reverse circulation.

Figure 3:
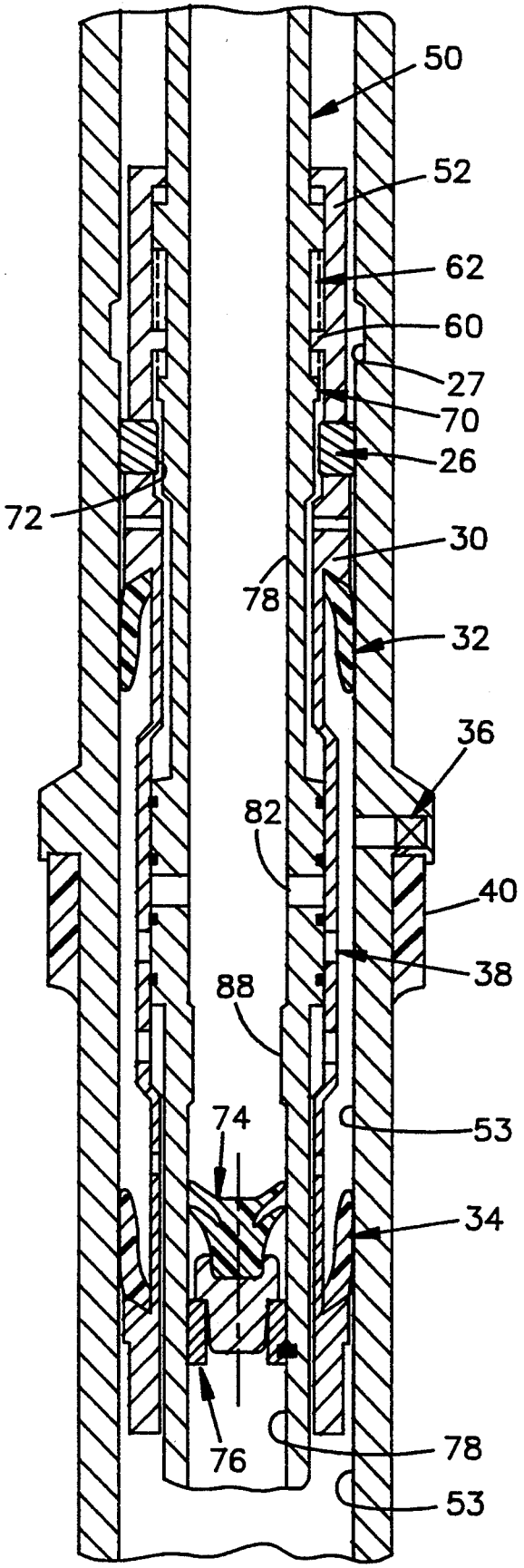
FIG. 3 is a schematic representation of the longitudinal cross-section of an embodiment of the well tool of the present invention in position for a pressure test.
Figure 4:
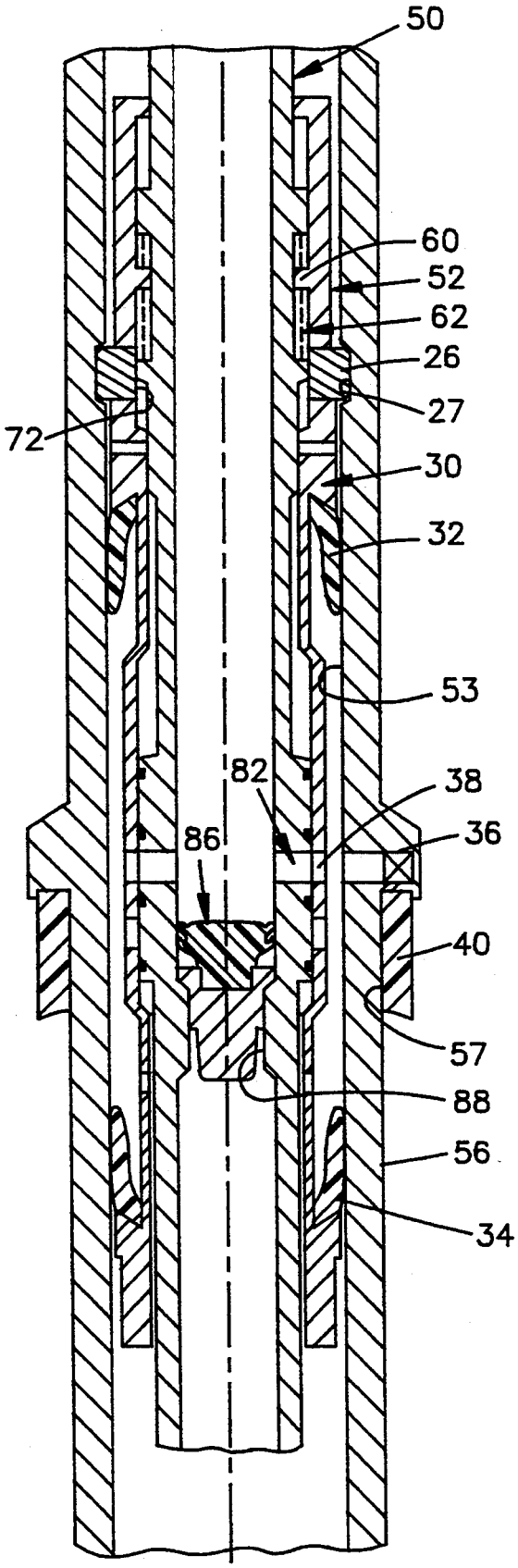
FIG. 4 is a schematic representation similar to FIG. 3 but showing the tool with a "valve open" condition.
Figure 5:
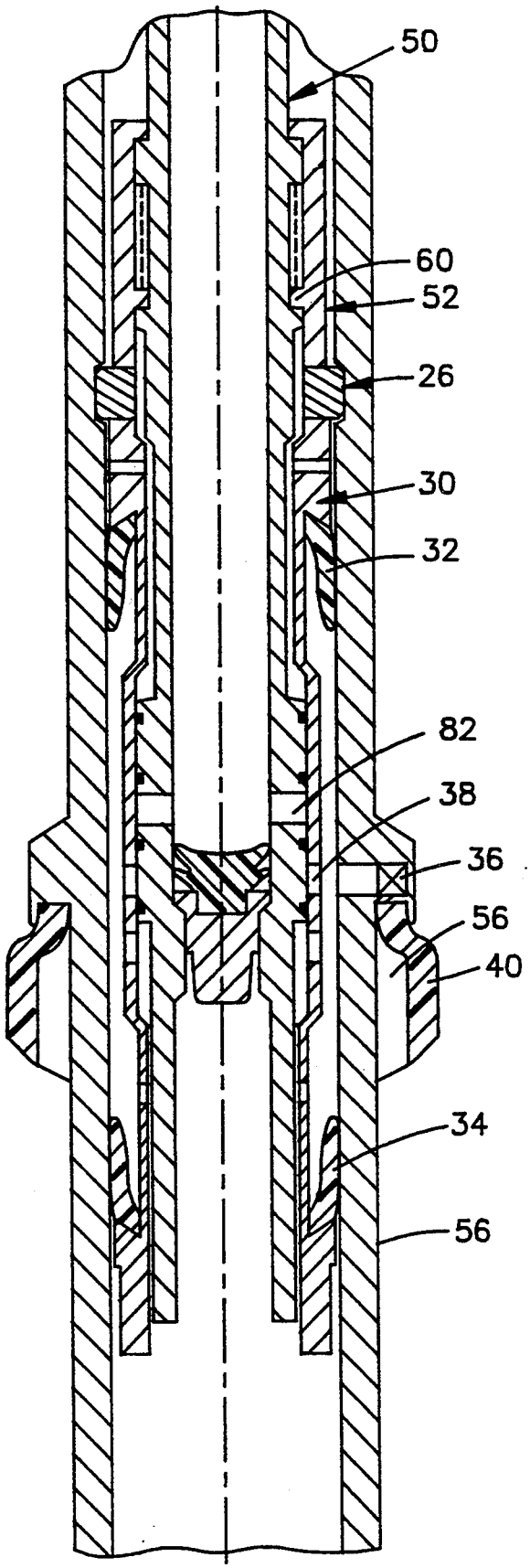
FIG. 5 is a schematic representation of the well tool of similar to FIG. 4 but showing the tool is a "valve closed" condition.

Referring now to FIGS. 3 to 6, FIG.3 schematically illustrates the well tool 30 in a "going-in" condition where a pressure test is to be conducted; FIG. 4 schematically illustrates the well tool 30 with the latching means 26 in a locked condition in an inflatable packer profile grove prior to inflation; and FIG. 5 schematically illustrates the well tool where the latching means 26 are an unlocked condition so that the well tool can move upwardly relative to the inflatable packer.

The well tool 30 has a central tubular inner mandrel assembly 50 which is connectable at an upper end to a circulation valve 40 and to a string of tubing 31. The inner mandrel assembly 50 is telescopically received within a tubular outer housing assembly 52.

The inflatable packer 19 has an access port and valve system 36 for the inflatable packer element. The valve system 36 admits liquid from the interior bore 53 of the inflatable packer to the annular interface between an outer wall of the housing 56 of the inflatable packer and the inner wall 57 of an elastomer element 40. The admission of liquid under pressure to the interface inflates the packer element 40 into sealing contact with the wall of a well bore and the valve system 36 prevents any back flow. If the liquid is a cement slurry, it hardens or sets up in the annular space 58 between the housing 56 and the packer element 40.

As may be appreciated, when more than one inflatable packer is in a well bore, it is desirable to be able to inflate all of the packers with one trip of a string of tubing in the well bore. Thus, the inflatable packers are typically located in spaced apart locations and are part of a string of pipe. Above each inflatable packer is a profile sub with an annular locking recess profile 27.

Figure 6:
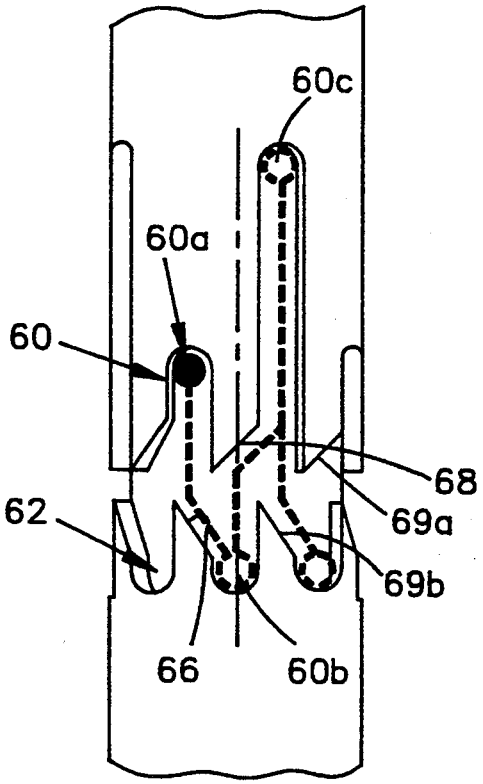
FIG. 6 is a view of an automatic J-slot system for the present invention.

The inner and outer assemblies 50, 52 of the well tool are interconnected to one another and relatively movable. The interconnection includes an tipper housing section with inwardly extending J-pins 60 which extend into an automatic J-slot system 62 (see FIG.6). Typically, a pair of J-pins 60 are located at a 180° relationship to one another. The J-slot system 62 is automatic in that reciprocating vertical or relative longitudinal motion of the inner tubular assembly 50 relative to the housing assembly 52 will index a J-pin 60 between an intermediate location 60*a*, a lower location 60*b* and an upper location 60*c* in the J-slot system 62. In FIG. 6, the J-pin 60 is shown for illustration purposes as moving relative to the J-slot system 62. In actuality, since the J-pin 60 is on the outer assembly 52 and the locking means 26 are also frictional drag blocks, the J-pin 60 will remain a given position while the J-slot system 62 on the inner assembly 50 reciprocates and rotates with respect to the J-pin 60. The reciprocation is between an intermediate location 60*a*, an upper location 60*b* (for the assembly 50) and a lower location 60*c* (for the assembly 50). The automatic operation is obtained by locating inclined guide surfaces 66 and 68 in alignment with the open end of an aligned longitudinal slot which causes the inner tubular assembly 50 to move in a given rotational direction with respect to the longitudinal outer tubular assembly 52. The J-pins 60 being attached to the housing assembly 52 cause the inner assembly 50 to rotate relative to the outer tubular assembly 52. A swivel connector (not shown) can be attached to the string of pipe at a location above the tool to accommodate rotation, if desired or necessary. Relative longitudinal movement between the inner tubular assembly 50 and the outer housing assembly 52 is achieved by the latching means 26 which are elongated, spring biased drag blocks 26 which also serve as latching members. The drag blocks 26 engage the wall of well pipe with sufficient frictional force to permit relative motion between the inner assembly 50 and the outer assembly 52. The drag blocks 26 and the profile 27 are elongated sufficiently so that the drag blocks do not accidentally enter any other outer wall recess (such as a joint coupling) in the string of pipe.

As shown in FIG. 3, the well tool is lowered into the well bore on the end of string of tubing. The latching means 26 (sometimes referred to as "anchor")consists of the elongated drag blocks which are spring biased outwardly to engage the wall of the well bore and resist the downward motion of the well tool. In the going-in position, the J-pins 60 are located in a J-slot location 60*a* (See FIG. 6). In this location of the J-pins 60, a locking wall portion 70 on the inner tubular assembly 50 is displaced upwardly from the inner wall surfaces 72 of the drag blocks. The well tool is lowered through the well bore and the operator can detect from the feel of the string of pipe and from the pipe length when the latching means 26 passes through a latching recess 27. With the latching means 26 located just below the latching profile 27, the operator drops a sealing dart 74 (See FIG. 3) into the tubing string and applies pressure until the sealing dart 74 seats in a releasable (shear pinned) tubular seat 76 in the bore 78 of the well tool. The operator can then apply pressure to a liquid in the string of tubing and test the integrity of the string of tubing to hold pressure when the packer cups are located in the bore 53 of the packer member. At this time, the inner tubular assembly 50 has access flow ports 82 sealed off with respect to the flow ports 38 in the outer housing assembly 52. When the pressure test is completed, the pressure is increased to a level where the shear pins in the seat 76 are sheared and the seat 76 and plug are displaced from the bore of the inner tubular assembly 50 and retained in the catcher sub 50*f*.

With a successful pressure test, the operator next raises the tubing string and the J-slot surface 66 is engaged by the J-pins 60 and relative rotation moves the J-pin 60 to the location 60*b* where the housing assembly 52 is also raised until the latching means 26 is raised above the latching profile 27. When the latching means 26 is above the profile 27, the string of tubing is again lowered so that the J-pins 60 engage the J-slot surface 68 and the pins 60 are moved to the position 64*c* in the J-slot and the latching means 26 are now engaged with the profile 27. In this position of the inner and outer assemblies 50, 52, the locking wall surface 70 on the inner tubular assembly 50 is under and in locking engagement with the rearward surfaces 72 of the drag blocks 28 of the latching means 26 so the drag blocks 28 are securely locked into the recess 27 (See FIG. 4). At this time the flow ports 82 of the tubular assembly are in alignment with the flow ports 38 of the outer housing assembly 52. A cementing dart 86 is inserted into the string of tubing and is followed by a cement slurry on the inflating liquid mud until the dart 86 seats in a seating flange 88 in the bore of the well tool. The seating flange 88 is located below the flow ports 82 so that the liquid can be forced through the flow ports 82, 38, and, under pressure, will open the valve 36 in the well packer and cause the elastomer packing element 40 to be inflated. After inflation of the packing element 40, the tubing string is again picked up and the J-pin 60 moves from the location 60*c* to the location 60*b* in the J-slot. In this position, the drag blocks in the latching means 26 are released and the flow ports 82 in the inner tubular assembly 50 are displaced and sealed off with respect to the flow ports 38 in the outer tubular housing 52. The string of tubing can then be raised to move the J-pin 60 from the location 60*b* to the location 60*a* and the tool can be raised to the next profile recess in the next packer.

The operation can then be repeated to inflate the next packer. As will be appreciated, the well tool is not required to be retrieved and the cementing or inflating liquid is retained in the string of tubing. When the last operation is performed, the string of tubing is raised to a location where the packer cups 32, 34 are in a blank section of pipe and the application of pressure will open the circulating valve 40 (See FIG. 2) and permit the liquid to be reversed out from the string of tubing.

Figure 7A:
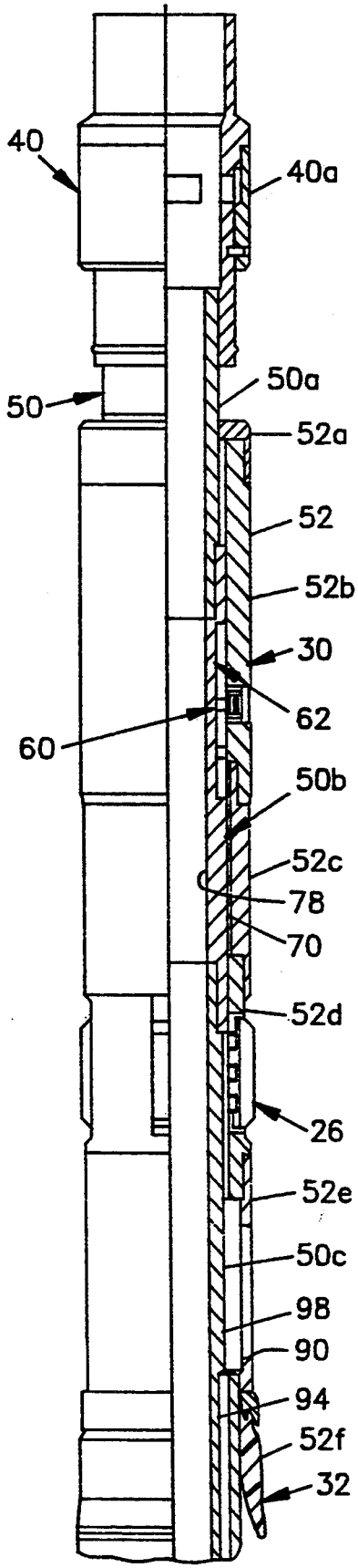
FIG. 7(*a*), 7(*b*), and 7(*c*) are views in longitudinal cross-section through a well tool embodying the present invention.
Figure 7B:
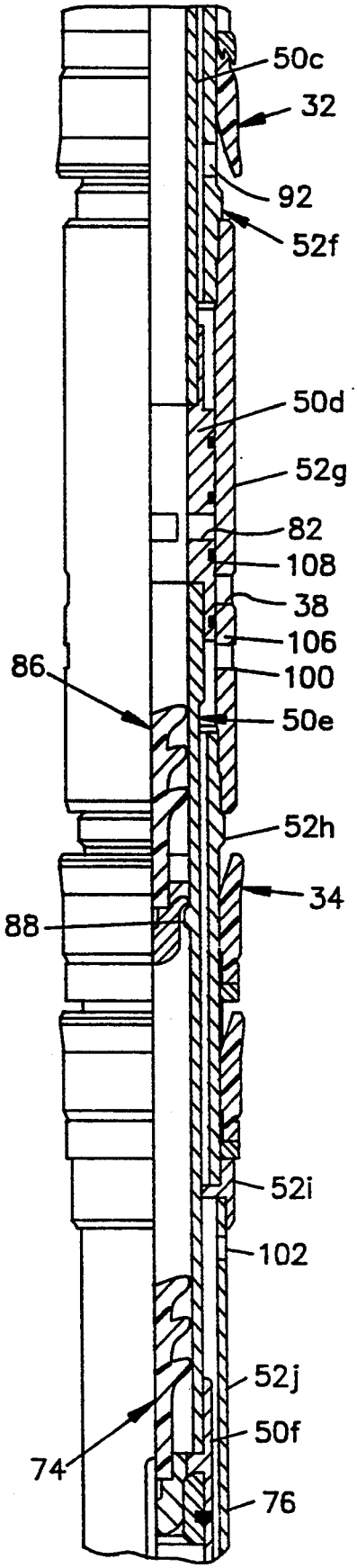
Figure 7C:
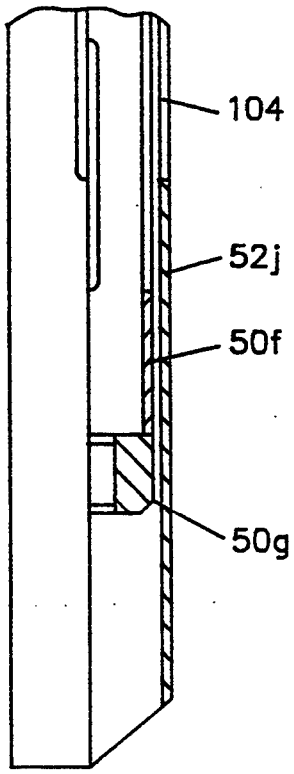

Referring now to FIG. 7(A)–7(C), the circulating valve 40 includes a housing with circulation ports and a pressure sleeve 40*a* slidably mounted on the housing. When the pressure applied to the circulation ports exceeds the shear strength of a connecting shear pin, the pressure sleeve is moved to a position where the circulation ports are opened.

The inner tubular assembly 50 consists of a number of interconnected tubular members including an upper mandrel 50*a*, an J-Slot index sleeve 50*b*, a anchor locking sleeve 50*c*, a valve port sleeve 50*d*, an upper plug sleeve 50*e*, a lower plug sleeve 50*f* and an end plug 50*g*. The outer tubular assembly 52 consists of an upper end cap 52*a*, a J-Pin housing 52*b*, a coupling sub housing 52*c*, and anchor sub housing 52*d*, a by-pass housing 52*e*, an upper cup housing 52*f*, a valve port housing 52*g*, a lower cup housing 52*h*, a connector 52*i*, and a tail pipe 52*j*. The J-pin's 60 are located in the J-slot system 62 for indexing and permitting relative longitudinal positioning of the inner and outer assemblies between a "going in" position, a "valve open" position and a "pulling out" position.

In the "going in" position shown in FIG. 7(*a–c*), the bypass housing 52*e* has an upper bypass port 90 above the upper cup elements 32 and a lower bypass port 92 (see FIG. 7*b*) below the cup elements 32 where the ports 90, 92 communicate with the annulus 94 between the inner and outer assemblies 50, 52 to permit fluid to bypass the cup elements while the tool is being run in the well bore (J-pin 60 is in the J-slot location 60*a*). This upper fluid bypass around the cup elements 32 is closed when the inner assembly is shifted downwardly by the use of seal elements 98 on the inner assembly 50. The seal elements 98 engage the inner bore of the cup housing 94 to close the bypass when the J-pin 60 is in the J-slot location 60*c*. Similarly, the valve port housing 52*g* has an upper bypass port 100 located below the valve port 38 but above the lower cup elements 34. The tailpipe 52*j* has lower bypass ports 102, 104 located below the lower cup elements 34. The lower bypass ports 100, 102, 104 permit liquid to bypass the lower cup elements 34 when the tool is going in the well bore (J-pin location 60*a*). When the tool is shifted to J-pin position 60*c*, seals 106, 108 isolate and close off the bypass port 100 while the valve ports 38, 82 are in communication. The upper and lower bypass ports are closed off before the valve ports 38, 82 are placed in fluid communication. Conversely, the valve ports 38, 82 are closed first before the bypass ports are opened.

The lower tubular seat 76 is shear pinned to the lower plug sleeve 50*f* and has an upwardly facing shoulder to engage with a dart member 74. The dart member 74, when positioned in the seat 76 closes off the bore of the pipe and permits an initial pressure test. When a pressure test is completed, additional pressure is applied to shear the shear pin and drop the dart 74 into the tail pipe 52*j* where fluid can bypass it via the bypass ports 104. The upper plug sleeve 50*e* has an internal flange or shoulder 88 which provides a seat for the second dart 86. The bore of the shoulder 88 is larger in diameter than the O.D. of the first dart member 74. When the second dart 86 is seated on the shoulder 88, the bore of the pipe is again closed off. The second dart 86 is pumped down the pipe string by the inflating liquid.

Figure 9:
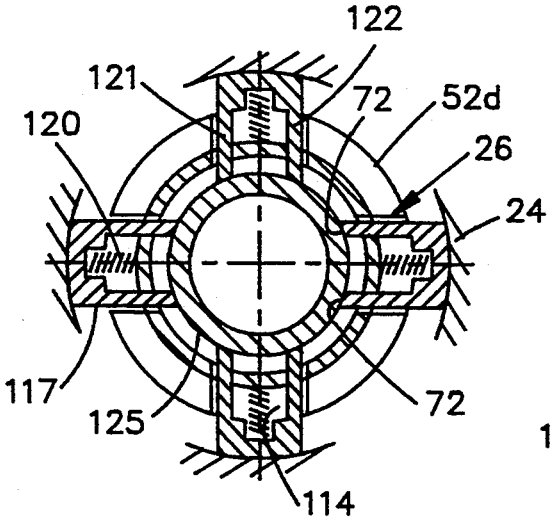
FIG. 9 is a view in cross section taken along line 9—9 of FIG. 8.
Figure 10:
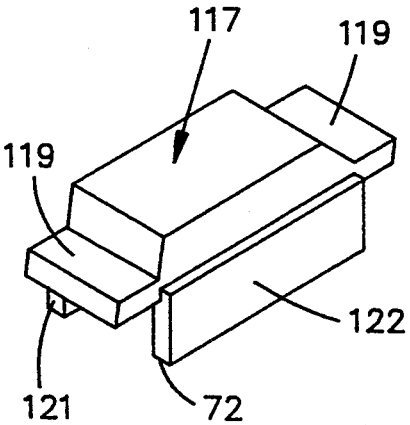
FIG. 10 is a view in perspective of a latching member used in the present invention.
Figure 8:
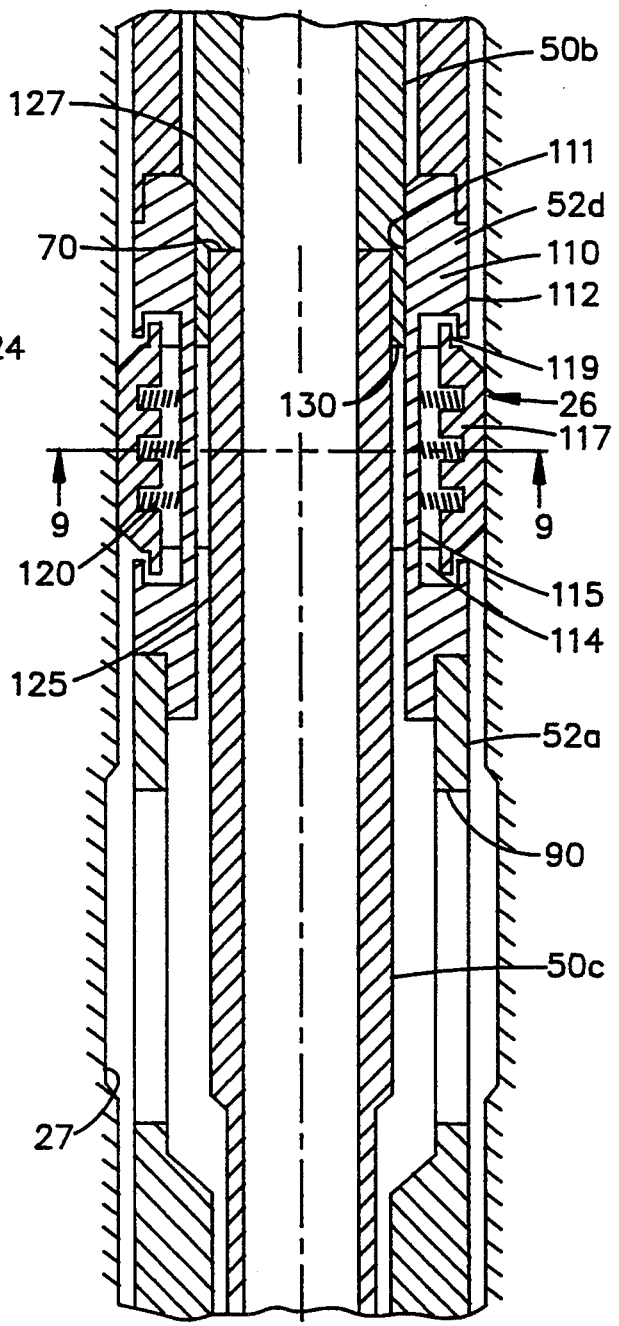
FIG. 8 is a view in longitudinal cross section of a portion of the well tool to illustrate the latching elements of the anchoring means.

Referring now to FIGS. 8–10, the details of the latching means 26 are illustrated. The anchor housing 52*d* is an annularly shaped member 110 with an inner wall 111 and an outer wall 112. At four (or more) circumferentially spaced locations are longitudinally extending recesses 114 which extend from the outer wall 112 to an inner recess wall 115. Disposed in each of the recesses 114 is the elongated friction latching drag member 117. A latching drag member 117 has end projections 119 which underlie retaining annular wall portions and prevent a latching member 117 from escaping from a recess. Spring members 120 are disposed in recesses in a latching member 117 and are compressed between the latching member and the inner recess wall 115. The spring members 120 resiliently urge the latching members 117 outwardly from the tool and produce a frictional engagement with the wall surface of a well pipe when the tool is in the well pipe. Each latching member 117 has spaced apart, lengthwise extending, actuating members 121, 122 (see FIG. 9, 10) which extend through elongated slots in the wall surface 115 so that the inner wall or end surfaces 72 of the actuating members are in engagement with the outer surface 125 of the inner tubular member 50*c*.

The outer surface 125 of the inner tubular member 50*c* adjoins an upper enlarged diameter wall surface 127 on the tubular member 50*b*. When the latching members 117 reach an annular profile recess 27 in the bore of the packer, the springs 120 cause the latching members 117 to be resiliently extended into the recess 27 and the end surfaces 72 are displaced outwardly so that the anchor locking sleeve 50*c* can be moved downwardly (from J-Pin location 60*b* to 60*c*) and place the wall surface 127 underneath the end surfaces 72 and prevent the latching members from being released from the profile recess while the wall surface 127 is underneath the end surfaces 72. During this period of time the valve is open in the well tool. When the valve is closed (movement from J-pin location 60*c* to 60*b* to 60*a*) the wall surface 127 is removed from the locking position behind the latching elements and they are free to be displaced inwardly and permit the well tool to be moved relative to the well packer. It should be noted that when the surface 127 is in the position shown in FIG. 8, that the drag blocks cannot be accidentally set irrespective of the J-slot position because the shoulder 130 will engage the end of the actuating members. Thus, the drag blocks cannot be actuated except when they are received in a latching profile.

It will be apparent to those skilled in the art that various changes may be made in the invention without departing from the spirit and scope thereof and therefore the invention is not limited by that which is disclosed in the drawings and specifications but only as indicated in the appended claims.

I claim:

1. A method for inflating an inflatable packer in a well bore where the inflatable packer is on a string of pipe in the well bore and inflatable to seal off a well bore in response to an inflation liquid being admitted through an pressure inflation valve opening to a central bore in the inflatable packer, said method comprising the steps of:

lowering a straddle inflation tool on a string of tubing through the string of pipe to a communication location within the central bore of the inflatable packer where the pressure inflation valve in said inflatable packer can be placed in fluid communication with a flow valve in said inflation tool;

coupling the inflation tool to said inflatable packer in the communication location to prevent movement by positively locking elements on the inflation tool in a profile recess in the inflatable packer so that manipulation of the string of tubing can be used with the inflation tool to operate the flow valve in said inflation tool;

opening the flow valve in said inflation tool by a longitudinal movement of the string of tubing relative to the inflation tool;

supplying an inflation liquid through said string of tubing to said flow valve in said inflation tool to the pressure inflation valve in said inflatable packer for inflating said inflatable packer to seal off the well bore;

after inflating said inflatable packer, closing the flow valve in said inflation tool by a longitudinal movement of said string of tubing; and uncoupling the inflation tool from said inflatable packer so that said inflation tool can be moved with the string of tubing to another location.

2. The method as set forth in claim 1 wherein the inflatable tool has an open bore and including the further step of:

dropping a plug member into the string of tubing to a stop location below the flow valve to close the bore of the inflation tool below the flow valve before supplying the inflation liquid under pressure.

3. The method as set forth in claim 2 wherein the inflation liquid is a liquid cement slurry.

4. The method as set forth in claim 1 wherein the inflation tool is moved in the well bore to another inflatable packer location in the string of pipe with the flow valve closed and carrying therewith the inflation liquid and the above steps are repeated to inflate the other inflatable packer.

5. The method as set forth in claim 4 wherein the inflation tool is positioned in a blank section of the string of pipe and a circulation valve is opened above the inflation tool to reverse out the inflation liquid in the string of tubing.

6. A method for inflating more than one inflatable packer disposed in a well bore where the inflatable packers are on a string of pipe in the well bore and are inflatable in response to an inflation liquid being admitted through a pressure inflation valve in an inflatable packer, said method comprising the steps of:

lowering an inflation tool on a string of tubing to a location within one inflatable packer;

placing the pressure inflation valve to said one inflatable packer in fluid communication with a flow valve in the inflation tool;

coupling locking elements on the inflation tool to said one inflatable packer to prevent movement by mechanically locking the locking elements in a profile recess in said one inflatable packet so that manipulation of the string of tubing can be used to operate the flow valve in said inflation tool;

opening the flow valve in said inflation tool by a longitudinal movement of the string of tubing and supplying an inflation liquid through said string of tubing to said flow valve in said inflation tool to the pressure inflation valve in said one inflatable packer;

after inflating said one inflatable packer, closing the flow valve in said inflation tool by a longitudinal movement of said string of tubing to retain the inflation liquid in the string of tubing;

uncoupling the locking elements of the inflation tool from said inflatable packer and moving said inflation tool with the string of tubing and the inflation liquid to the other inflatable packer;

placing the pressure inflation valve to said other inflatable packer in fluid communication with the flow valve in the inflation tool;

coupling the locking elements in the inflation tool to said other inflatable packer to prevent movement by mechanically locking the locking elements on the inflation tool in a profile recess in the said other inflatable packer so that manipulation of the string of tubing can be used to operate a flow valve in said inflation tool;

opening the flow valve in said inflation tool by a longitudinal movement of the string of tubing and applying pressure to the inflation liquid in said string of tubing and to the pressure inflation valve in said other inflatable packer to inflate said other inflatable packer;

after inflating said other inflatable packer, closing the flow valve in said inflation tool by a longitudinal movement of said string of tubing to retain the inflation liquid in the string of tubing; and uncoupling the locking elements of the inflation tool from said other inflatable packer and moving said inflation tool with the string of tubing and the inflation liquid.

7. The method as set forth in claim 6 and further including moving the string of tubing, after inflating said other inflatable packer, to a blank section of the string of pipe and opening a circulation valve above the inflation tool and supplying a liquid under pressure to the inflating liquid in the string of tubing to reverse circulate the inflating liquid to the earth's surface.

8. A method for processing a communication location in a string of pipe disposed in a well bore, said method comprising the steps of:

lowering a cup type straddle tool with a selectively operable flow valve on a string of tubing through the string of pipe to the communication location so that the string of tubing can be placed in fluid communication with the communication location and where the communication location is disposed between the cups of the cup type straddle tool and where the flow valve is selectively operable between open and closed conditions by relative longitudinal motion between the string of tubing and the string of pipe, coupling the straddle tool to said string of pipe in the communication location to prevent movement by positively locking elements on the straddle tool in a profile recess in the string of pipe so that manipulation of the string of tubing can be used with the straddle tool to operate the flow valve in said straddle tool;

opening the flow valve in said straddle tool by a longitudinal movement of the string of tubing relative to the straddle tool for placing said string of tubing in fluid communication through said flow valve in said straddle tool to the communication location;

closing the flow valve in said straddle tool by a longitudinal movement of said string of tubing; and uncoupling the straddle tool from said string of pipe so that said straddle tool can be moved with the string of tubing to another location.

9. The method as set forth in claim 8 wherein the straddle tool has an open bore while going in the string of pipe and further including the steps of:

dropping a plug member into the string of tubing to a stop location below the flow valve to close the bore of the straddle tool below the flow valve.

10. The method as set forth in claim 9 wherein the other liquid is a liquid cement slurry.

11. The method as set forth in claim 9 and further including the steps of:

supplying a liquid under pressure to the communication location, releasing the pressure on the liquid and closing the flow valve;

moving the straddle tool in the well bore to another communication location in the string of pipe with the flow valve closed and carrying therewith the liquid; and at the other communication location repeating the above steps to place the liquid in communication under pressure with said other communication location.

12. The method as set forth in claim 11 and including the step of moving the straddle tool to a blank section of the string of pipe and opening a circulation valve above the straddle tool to reverse out the liquid in the string of tubing.

13. A method for utilizing a cup type straddle tool for multiple operations in a string of pipe in a well bore where the straddle tool is on a string of tubing and is utilized to place a liquid in the string of tubing in a communication location in the string of pipe, said method comprising the steps of:

lowering a cup type straddle tool on a string of tubing to a first communication location in the string of pipe;

coupling locking elements on the straddle tool to said first communication location to prevent movement by mechanically locking the locking elements in a profile recess in said string of pipe so that manipulation of the string of tubing relative to the string of pipe can be used to operate a flow valve in said straddle tool;

opening the flow valve in said straddle tool by a longitudinal movement of the string of tubing and supplying an liquid through said string of tubing to said flow valve in said straddle tool to the first communication location in said string of pipe;

after supplying a desired amount of liquid to said first communication location, closing the flow valve in said straddle tool by a longitudinal movement of said string of tubing to retain the liquid in the string of tubing;

uncoupling the locking elements of the straddle tool from the string of pipe and moving said straddle tool with the string of tubing and the liquid to second communication location in the string of pipe;

coupling the locking elements in the straddle tool to said string of pipe at said second communication location to prevent movement by mechanically locking the locking elements on the straddle tool in a profile recess in the string of pipe so that manipulation of the string of tubing can be used to operate the flow valve in said straddle tool;

opening the flow valve in said straddle tool by a longitudinal movement of the string of tubing and supplying the liquid in said string of tubing to the second communication location;

after supplying a desiring amount of liquid to said second communication location, closing the flow valve in said straddle tool by a longitudinal movement of said string of tubing to retain the liquid in the string of tubing; and uncoupling the locking elements of the straddle tool from said second communication location and moving said straddle tool with the string of tubing and the liquid.

14. The method as set forth in claim 13 and further, moving the string of tubing from second communication location to a blank section of the string of pipe; and opening a circulation valve above the straddle tool and applying pressure to the liquid in the string of tubing to reverse circulate the liquid from the string tubing through the string of pipe to the earth's surface.

15. A method for processing a communication location in a string of pipe disposed in a well bore with a cup type straddle tool on a string of tubing where the straddle tool has a flow valve with a central bore where the flow valve is selectively operable between open and closed conditions and is located between cup members on the straddle tool and has spring biased friction elements which are selectively operable between a spring biased condition and a locked extended condition and has an automatic J-slot system which permits repeatable movement in the straddle tool between sequential intermediate, upper and lower positions, said method comprising the steps of:

locating a plug member in the straddle tool at a location where the plug member is disposed below said flow valve;

locating the straddle tool in the string of pipe with the J-slot system in an intermediate position and the flow valve closed and the central bore open at a location where the friction elements are in a profile groove in the string of pipe and the cup members of the straddle tool straddle the communication location;

opening the flow valve by longitudinal motion of the string of pipe by moving the J-slot system from the intermediate position through the lower position to the upper position and mechanically locking the friction elements in the profile groove and placing the liquid in the string of tubing in fluid communication with the communication location in the string of pipe in the lower position; and closing the flow valve by longitudinal motion of the string of pipe to move the J-slot system from the lower position through the upper position to the intermediate position and releasing the mechanical locking of the friction elements so that the tool can be moved to another location.

* * * * *